United States Patent [19]

Coch et al.

[11] Patent Number: 4,514,093

[45] Date of Patent: Apr. 30, 1985

[54] METHOD AND APPARATUS FOR DELIVERY OF A POWDER

[75] Inventors: Lester Coch, Northport; Kurt Rauch, Kew Gardens, both of N.Y.

[73] Assignee: Waldes Kohinoor, Inc., Long Island City, N.Y.

[21] Appl. No.: 463,023

[22] Filed: Feb. 1, 1983

[51] Int. Cl.[3] ..... B01F 9/04

[52] U.S. Cl. ..... 366/138; 366/154; 366/220; 118/19; 118/303

[58] Field of Search ..... 366/138, 152, 155, 160, 366/161, 162, 167, 170, 172, 173, 179, 180, 182, 192, 220, 348; 118/19, 302, 303, 612, DIG. 4; 137/607, 869, 596.15

[56] References Cited

U.S. PATENT DOCUMENTS

| | | | |
|---|---|---|---|
| 2,347,357 | 4/1944 | Mason | 366/167 |
| 2,785,803 | 3/1957 | Young | 239/DIG. 1 |
| 2,900,176 | 8/1959 | Krogel | 366/161 |
| 3,150,215 | 9/1964 | Houghton | 366/155 |
| 3,550,552 | 12/1970 | Archibald | 118/302 |
| 3,780,991 | 12/1973 | Evans | 366/179 |
| 4,334,786 | 6/1982 | Delcoigne | 366/138 |

*Primary Examiner*—Robert W. Jenkins
*Assistant Examiner*—Arthur D. Dahlberg
*Attorney, Agent, or Firm*—Burns, Doane, Swecker & Mathis

[57] ABSTRACT

The present invention relates to a method and apparatus for controlling the delivery of insoluble powders, such as metal powders, to a processing station, such as a rotatable drum for impact plating of the powder onto articles. The method includes providing separate supplies of water and a slurry of the metal powder. Water is delivered from the water supply through a fluid network to the rotatable drum in a pre-flushing operation for a first predetermined length of time. Upon stoppage of the pre-flush with water, the slurry is delivered to the drum through the fluid network for a second predetermined length of time sufficient to deliver a desired quantity of the powder to the drum. Upon stoppage of the slurry delivery, a post-flush with water supplied through the fluid network is undertaken for a third predetermined length of time to remove any residual slurry within the fluid network.

8 Claims, 1 Drawing Figure

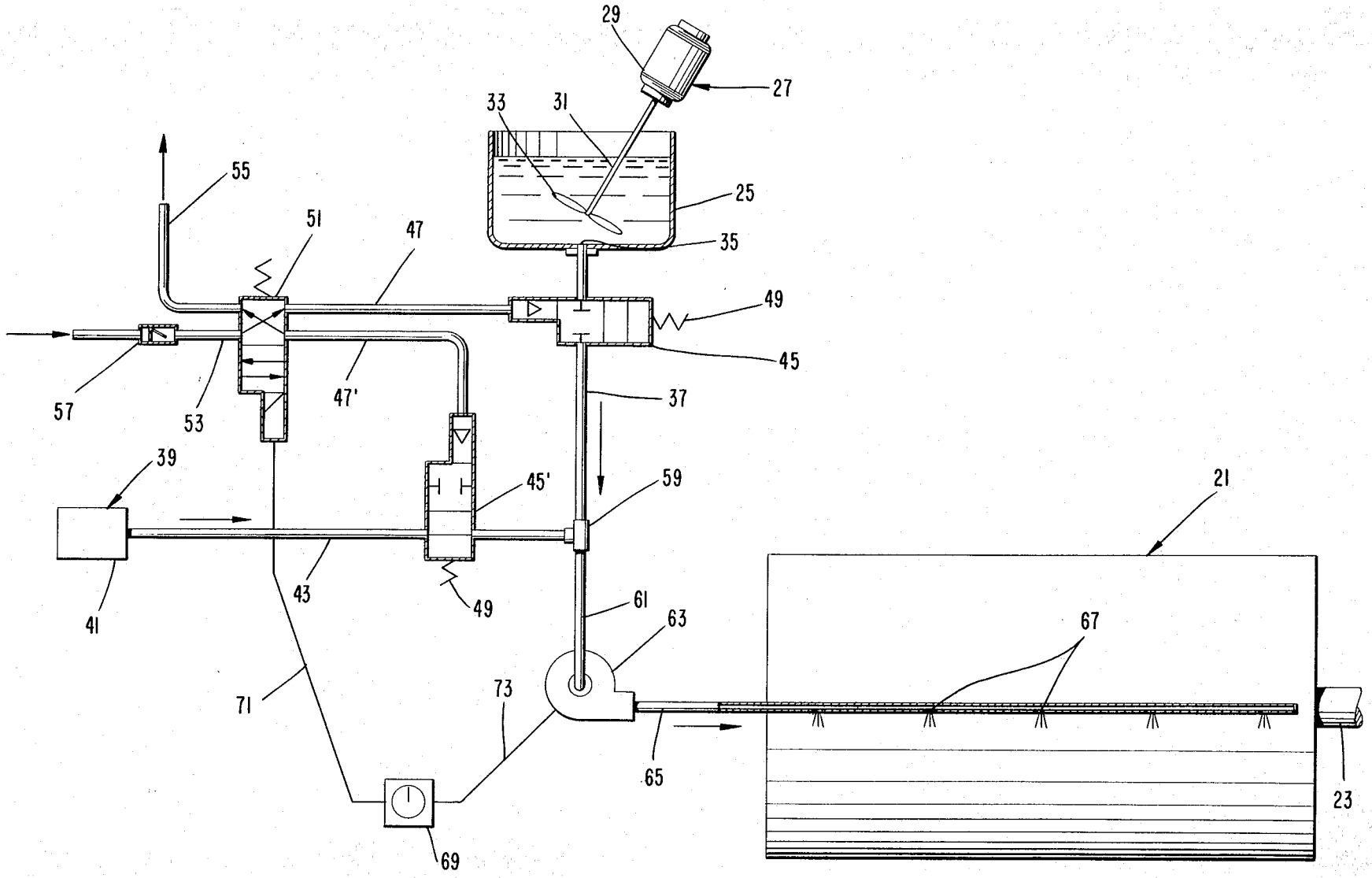
23
21
67
27
25
35
49
45
29
31
33
37
59
61
63
65
45'
49
73
69
47
47'
51
43
71
55
53
39
41
57

METHOD AND APPARATUS FOR DELIVERY OF A POWDER

BACKGROUND AND SUMMARY OF THE PRESENT INVENTION

The present invention relates to a method and apparatus for intermittently delivering an insoluble powder to a processing station. More particularly, the present invention relates to a method and apparatus for controlling the delivery of metal powder to an outlet arranged within a rotatable drum adapted for impact plating of the metal powder onto base metal articles.

A wet impact plating process in which metal powder particles are applied to a base metal by impacting against the surfaces of the base metal is known. In general, the parts or articles to be plated are placed within an agitator container generally in the form of a rotatable drum or barrel. Oftentimes, an impacting media, such as a mass of fine glass shot, and a suitable surface preparation agent are added to the drum with a predetermined quantity of liquid such as water for cleaning the base metal parts. The container is agitated, e.g., by rotation of the drum, in order to prepare the parts by the combined action of the impacting media and the agent. In the known methods, the parts to be plated are generally copper flashed after the surface preparation and before the actual plating process begins.

The actual plating in the prior art is accomplished by manually inserting a quantity of the plating metal in powder form within the agitator drum. Typically, a chemical plating accelerator or promoter is added along with the metal powder in an attempt to aid in proper mixing of the metal powder particles with the water contained within the agitator drum. After plating is complete, the drum is again agitated for a predetermined length of time until the parts are properly plated. Thereafter, the drum or container is opened and drained of liquids and the plated metal parts or articles are separated from the particulate impact media.

A plating process of this general type is disclosed, for example, in U.S. Pat. Nos. 3,690,935 issued Sept. 12, 1972 to Coch and 4,062,990 issued Dec. 13, 1977 to Coch.

One problem associated with these known wet impact plating methods is the control of the quantity of metal powder particles manually admitted to the drum. Such a manual insertion of the powder causes various problems in the plating process. For example, the manual insertion of the powder particles requires a stoppage of the processing and an opening of the drum to permit the introduction of the powder. Further, the quantity of powder delivered to the agitator drum may not be uniform for each charge of metal parts to be plated.

Still further, the dispersing of the insoluble metal particles within the liquid body in the drum is difficult. In other words, the agitator drum must be operated for a short period of time to properly disperse and mix the powder within the liquid in the drum. This is particularly true when the entire metal powder charge is delivered as a single batch directly into the drum. Also, such a concentration of the metal powder within a small area in the drum may lead to uneven plating of all the parts within the drum. For example, parts located close to the introduction point of the metal powder charge receive a large quantity of the plating powder initially. In contrast, parts arranged within the drum at a location spaced from the introduction point of the metal powder particles do not receive initial plating particles until after a period of agitation of the drum to disperse the particles throughout the liquid therein. The addition of a chemical accelerator or promoter along with the metal powder particles aids in mixing or dispersing the particles more quickly within the liquid in the container. However, it has been found that even with the use of such a material, the metal plating may be inconsistent from one metal part to another depending upon their location in the drum relative the point of introduction of the powder.

One proposed solution to the problem of poor plating of the metal powder onto metal parts is disclosed in U.S. Pat. No. 3,268,356 issued Aug. 23, 1966 Simon. In this patent, metal powder and/or plating promoter chemicals are incrementally provided to a plating barrel by hand or are provided at one time in the form of a slowly dissolving bar. Each of these techniques is accompanied with disadvantages. In particular, incremental addition entails the use of additional labor and may result in inaccurate measurement and/or improper timing of the increments. Additionally, where a closed horizontal drum is employed, the drum would have to be stopped so that access to its interior can be obtained. With regard to the use of a slowly dissolving bar, many factors, such as water temperature, amount and shape of the parts, rotational speed, etc., will affect the rate of dissolution. Since the bar is manufactured in a single form, the addition of metal cannot be tailored to a particular application. Other similar prior art techniques are similarly deficient for at least these reasons.

Accordingly, it is highly desirable object to develop a method and apparatus for delivering an insoluble powder automatically to an agitator drum or plating barrel. Such an automatic system should be capable of delivering a measured quantity of the powder in a generally uniform fashion to the agitator drum.

The present invention accomplishes the above desired objects and overcomes the drawbacks of the prior art. It has been discovered in the present invention that the addition of the metal powdered particles may be more carefully controlled if the particles are first prepared into a slurry for delivery to the agitator drum or other processing station. However, due to the nature of the powder particles, the delivery of the slurry entails special problems. For example, the slurry may easily clog piping or tubing used to transport the slurry to the drum after stoppage of the delivery of the slurry. Also, any discharge nozzles or outlet openings may become clogged. Still further, if an outlet is arranged within the agitator drum or plating barrel, the agitation operation within the drum forces various fluid and suspended particles back into the outlet in the container thereby further clogging the slurry delivery network.

In accordance with the present invention, these problems of slurry delivery, in addition to the problems previously mentioned with regard to the addition of metal powder particles to a processing station, are overcome. The method of intermittently delivering an insoluble powder to a processing station according to the present invention includes the steps of supplying a slurry comprised of the insoluble powder. A fluid network for supplying fluids to the processing station is pre-flushed prior to delivery of a predetermined quantity of the slurry through the fluid network to the processing station. After delivery of the slurry, the fluid network is post-flushed to remove any residual slurry.

With these steps, the present invention alleviates the aforementioned problems of both fluid within the processing station re-entering the fluid network and clogging of the fluid network by any residual slurry remaining in the fluid network after stoppage of the delivery of the slurry to the processing station. In particular, the pre-flushing of the fluid network clears any fluid and particulate matter entering the fluid delivery network from the operation of the processing station in a previous batch process which matter has clogged the outlets of the fluid network. The post-flushing of the fluid network removes any residual slurry remaining after stopping the delivery of the slurry. Further, the post-flushing ensures that the entire predetermined quantity of the slurry is delivered to the processing station. In this way, precise control over the quantity of metal powder delivered to the processing station is obtained.

In accordance with a further aspect of the present invention, the slurry is continuously agitated prior to the delivery of the slurry to the fluid network. In this way, a uniformity of the slurry, i.e., the mass quantity of metal powder particles per volume of slurry, is more effectively maintained. Still further, the present invention controls the length of time over which both the pre-flushing and the post-flushing steps occur in order to minimize the quantity of water delivered to the processing station. Such an arrangement further ensures the consistency of the processing step utilizing the metal powder slurry. In a particularly preferred embodiment, the time for pre-flushing is substantially less than the time for the post-flushing since the amount of material to be pre-flushed is substantially less than the amount of residual slurry. In accordance with a further aspect of the present invention the discharge of the slurry to the processing station is arranged to be generally uniform throughout the processing station.

An apparatus for controlling the delivery of metal powder to a rotatable drum for impact plating of base metals according to the present invention includes a supply of both water and a slurry of the metal powder. At least one outlet opening is arranged within the rotatable drum and a fluid network interconnects each of the supplies with the at least one outlet opening. A control is arranged within the fluid network for selectively individually admitting water or slurry through the fluid network to the drum in a predetermined supply sequence including a pre-flush with water, a supply of slurry and a post-flush with water.

In a preferred embodiment, the control comprises a first valve arranged between the outlet opening and the slurry supply and a second valve arranged between the outlet opening and the water supply. A control valve is provided for delivering a signal to regulate the open and closed positions of the first and second valves to accomplish the predetermined supply sequence. In accordance with the preferred embodiment, a timer is provided for actuating the control valve to deliver the signal to the appropriate one of the first and second valves for a predetermined length of time. In this way, the length of time of the pre-flush, the slurry delivery and the post-flush operations can be carefully controlled in order to minimize the amount of water added and to deliver the precise quantity of slurry, and more ularly metal powder, to the rotatable drum.

Again it is noted that by minimizing the amount of water, the processing within the drum can be more closely controlled. In particular, the relative quantities of liquid and other particles within the drum are not adversely affected by the small addition of water required for the delivery of the slurry according to the present invention.

Further in the preferred embodiment, a pump is provided in the fluid network upstream of the outlet opening for delivering the selected fluid to the outlet opening. In the preferred embodiment, a plurality of outlet openings are arranged along an elongated tube having one end connected to the fluid network and extending into the drum generally parallel to a longitudinal axis of the drum. In this way, a substantially more uniform distribution of the slurry to the drum is accomplished. In a particularly preferred embodiment, the size of the openings within the tube increases in a direction from the end connected to the fluid network to further ensure uniform distribution of the slurry to the drum.

BRIEF DESCRIPTION OF THE DRAWING

A preferred embodiment of the present invention will be described in greater detail with reference to the accompanying drawings wherein the single drawing FIGURE comprises a schematic representation of the apparatus for controlling the delivery of an insoluble powder to a processing station according to the present invention.

DETAILED DESCRIPTION OF THE PREFERRED EMBODIMENT

While the present invention will be described with particular reference to an impact plating process employing a rotatable drum or barrel agitator, it is to be understood that the method and apparatus according to the present invention may be useful for other similar and related processes. For example, the present invention may be applicable to immersion plating processes or other wet metal surface treatment processes which require the introduction of an insoluble powder.

With reference to the drawing FIGURE, a processing station 21 is provided for receiving a slurry of powder according to the present invention and for accomplishing subsequent processing utilizing the powder within the station 21. The station 21 may comprise a container having a suitable arrangement for imparting mechanical energy, i.e., agitation, to the contents therein. For example, the container may be a closed or an open top barrel or drum having a shape which can induce agitation when rotated, for example, a polygonal cross section or a round barrel with internal struts which can be rotated about a horizontal axis 23 of the closed drum or an inclined axis (not shown) of an open top barrel. Since such processing apparatus are known, for example, in the aforementioned U.S. Pat. Nos. 3,690,935 and 4,062,990 the contents of which are incorporated by reference, these apparatus will not be further described in detail in the present application.

In accordance with the present invention, an apparatus for controlling the delivery of metal powder to the station 21 is provided. The apparatus includes a tank 25 or other suitable container for holding a slurry of the desired metal powder. The metal powder may comprise particles of 2–40 microns and may be zinc, cadmium, tin, brass or possibly aluminum. A suitable chemical plating accelerator well known to those skilled in the art, may also be provided within the slurry to maintain the proper environment for plating as disclosed in aforementioned U.S. Pat. Nos. 3,268,356, 3,690,935, 4,062,990 and other patents in the mechanical plating art such as U.S. Pat. Nos. 3,328,197 and 3,460,977, the contents of which are incorporated by reference. The quantity of water employed to generate the slurry should only be sufficient to permit transportation of the slurry through the fluid network. The amount of water required varies with the metal employed and the size of the powder particles. In other words, the amount of water in the slurry should be maintained at a minimum. In addition, the mass of the dispersed metal particles for a given volume of the liquid should be known in order to ensure that the amount of powder delivered to the processing station 21 (as will be described subsequently) can be carefully controlled. The tank 25 includes an outlet 35 for removal of the slurry from the tank 25 in a line 37.

When utilizing zinc powder, a slurry comprised of 1.5 grams of zinc powder per milliliter of slurry has been found to be acceptable for use in the method and apparatus according to the present invention. Other metal powders may require a different mass to volume ratio of powder to slurry to be effectively transported within a fluid network.

In order to further ensure a uniform dispersion of the powder within the water of the slurry in the tank 25, an agitator 27 is preferably arranged within the tank 25. The agitator 27 may be of a known type including a motor 29 which drives a shaft 31 having agitator blades 33 at an end thereof. One commercially available unit that has been found acceptable for continuously agitating the slurry within the tank 25 is a 1 ½horse power, 350 rpm motor with a ten and one half inch diameter agitator blade which is manufactured under the name Lightnin, Model ND-4 230/3/60. This model is also available in a variable speed control version designated 230/1/60.

A water supply 39 in the form of a tank or a connection to an incoming water supply is provided with an outlet 41 for removing water from the supply 39 in a line 43. Each of the lines 37, 43 contain a valve element 45, 45', respectively, for selectively opening and closing the lines 37, 43 for fluid passage therethrough. Each of these valves 45, 45' is a two position valve which is moved between open and closed positions by delivery of, for example, pressurized air, in a line 47, 47', respectively. A suitable spring 49 may be provided to bias the valves to one position in the absence of pressurized air. In the illustrated embodiment, both the slurry valve 45 and the water valve 45' are biased toward the open position.

The slurry and water valves 45, 45' each preferably comprise a pinch valve having a steel sleeve with a flexible inside rubber tube (not shown). Upon the application of air pressure, the inside rubber tube is compressed to prevent the passage of fluid therethrough. Such a valve has been found particularly adapted for use in the transportation of the slurry due to its high resistance to abrasion. A suitable valve is marketed under the name Red Valve, Series 2600, Miniflex, with a ½" inside diameter.

The application of pressurized air to each of the valves 45, 45' is controlled by a control valve 51. The control valve 51 has outlets connected to the lines 47 and 47' connected to the slurry and water valves, respectively. The control valve 51 includes an inlet line 53 for pressurized air from a source (not shown) and an exhaust line 55 for releasing pressure to the atmosphere. The control valve 51 may be moved to supply pressurized air to one of the valves 45, 45' and to vent the other valve or vice versa. The pressurized air in the line 53 may include a suitable check valve 57 if desired. The control valve 51 preferably comprises a two position, 4-way single solenoid actuated valve element. A suitable control valve is manufactured by Asco under the name of Red Hat Model No. 8342B1.

In the illustrated position, the control valve permits the introduction of pressurized air to the slurry valve 45 while venting air pressure from the water valve 45' through the pipe 47' and the line 55 to the atmosphere. Accordingly, in the illustrated position the water delivery line 43 is open, i.e., permits flow of water therethrough, while the slurry valve 45 is in the closed position, i.e., preventing the flow of slurry therethrough, in response to the air pressure applied through the control valve 51.

The slurry supply line 37 and the water supply line 43 meet at a junction 59 and are connected via a line 61 to an inlet of a pump 63. The pump 63 is preferably a peristoltic pump which has been found most suitable for handling and delivering the slurry. A suitable pump is designated Tat High Vacuum Pump, Model No. 410-3, 10/1/60 having a 4.6 to 1 gear ratio with a 3 to 1 pulley reduction. Such a pump is capable of a maximum pressure of approximately 75 psi as 121 rpm.

The outlet of the pump 63 is connected to an elongated tube 65 which extends into the processing station or drum 21 substantially parallel to a longitudinal axis of the drum 21. The elongated tube 65 includes a plurality of openings 67 arranged along the length of the tube 65 within the processing station or drum 21. The openings 67 form outlets for the fluid delivered from the pump 63 into the rotatable drum 21. By providing a plurality of openings 67 in the tube 65, a more uniform distribution of the fluid delivered to the drum is obtained. In particular, by arranging the plurality of openings 67 along the longitudinal axis of the drum 21, a portion of the delivered fluid is discharged within each portion of the length of the drum.

In a particularly preferred embodiment, the size of the openings 67 is varied along the length of the tube 65. In other words, the size of the openings increases as the openings increase in distance from the outlet of the pump 63. In other words, the opening 67 closest to the outlet of the pump 63 is the smallest while the opening near the extreme end of the tube 65 is the largest. In this way, a more uniform distribution of the delivered fluid within the drum is obtained. In the preferred embodiment, the tube 65 has a ⅜ inch inside diameter with the openings 67 varying in size from slightly less than ⅛ inch to slightly greater than 3/16 inch.

A timer 69 is provided to regulate both the control valve 51 by actuation of the actuating solenoid of the control valve 51 through a line 71 and the energization of the pump 63 through the line 73. The timer 69 serves to regulate the length of time over which the control valve 51 remains in each of the two positions to which it is adapted to be moved. Further, the timer 69 controls the length of time over which the pump is turned on and off. The length of time over which the timer 69 controls each of these functions may be varied in a known manner within the timer 69. In other words, the timer 69 is provided to regulate the length of the predetermined supply sequence of the selected one of the fluids, i.e., water or slurry, to the processing station 21.

The operation of the apparatus and the method of controlling the delivery of the powder to the processing station 21 will now be described. At this stage of the plating process, the metal parts have already been subjected to surface preparation and possibly copper flashing. A supply 25 of a slurry of the insoluble power and water is provided along with a supply 39 of water. The control valve 51 is arranged in the illustrated position wherein pressurized air is provided to the slurry valve 45 to prohibit the passage of slurry through the line 37 and the water supply valve 45' is vented through the control valve 51 and the line 55 such that the water valve 45' permits passage of water through the line 43.

The timer 69 is actuated to turn on the pump 63 to deliver water from the water supply 39 through the line 43, the junction 59, the line 61, through the pump 63 and the tube 65 to the outlet openings 67 within the drum 21. This initial supply of water serves to pre-flush the fluid network interconnecting the water and slurry supplies with the outlet openings 67 to remove any unwanted fluid or particles therein. The delivery of water is stopped after a first predetermined length of time by movement of the control valve 51 by actuation from the timer 69 to the second (unillustrated) position.

In the second position, pressurized air is delivered through the line 47' to the water supply valve 45' to thereby prohibit the flow of water from the water supply 39 through the line 43. Simultaneously, the pressurized air in the slurry supply valve 45 is vented to the atmosphere through the line 47 and the line 55. Accordingly, the slurry supply valve 45 is now in the open position to permit flow of slurry through the line 37, the junction 59, the line 61, the still operating pump 63 and the tube 65 to the openings 67 for delivery to the rotatable drum 21.

The supply of slurry to the drum 21 is stopped after a second predetermined length of time determined by the quantity of powder which is desired to be delivered to the processing station 21. As noted previously, since the quantity of metal powder particles within the slurry is known, and the delivery rate of the pump is known, the quantity of metal powder particles delivered to the processing station 21 can be readily ascertained and carefully controlled. With the preferred peristoltic pump noted above, the delivery rate within a $\frac{3}{8}$ inch inside diameter tube 65 is 1731 milliliters per minute and with a $\frac{1}{2}$ inch inside diameter tube 65 the delivery rate is 2239 milliliters per minute. These values can of course be varied by variations in the pumping rate. Also, the amount of metal powder particles within the slurry can be varied to ensure proper passage of the slurry through the fluid network and into the processing drum 21.

After the predetermined length of time for slurry delivery has elapsed, the timer 69 again actuates the control valve 51 to return to the first position whereby pressurized air is vented from the water valve 45' to permit passage of water therethrough and pressurized air is delivered to the slurry valve 45 to terminate passage of slurry therethrough. Since the pump 63 is still operating at this time, additional water is supplied from the water supply 39 through the line 43, the line 61, the pump 63 and the elongated tube 65 to the outlet openings 67. This latter supply of water serves as a post-flushing for the entire fluid network. In other words, any remaining slurry in the line 61, the pump 63 or the elongated tube 65 is thoroughly flushed by the additional supply of water. The post-flushing also serves to ensure that the entire amount of slurry that flowed through the slurry valve 45 as determined by the timer 69 is delivered to the drum 21. In this way, precise control of the amount of powder delivered to the drum 21 for use in a single plating process is ensured. In order to ensure a proper flushing of the system, it is desirable that the length of the line 37 between the slurry valve 45 and the junction 59 be minimized.

After a third predetermined length of time, the post-flushing is stopped by turning off the pump 63 by the timer 69. At this stage, it should be noted that the water valve 45' remains in the open or water passing position ready for the next processing at which point the cycle of pre-flushing with water, slurry delivery and post-flushing with water is again undertaken.

It should again be noted that the pre-flushing serves to ensure that the fluid network is clear of fluid and suspended particles prior to delivery of the slurry to the processing station 21. Such clogging with fluid and/or suspended particles occurs during the processing within the station 21, i.e., rotation of the drum. In particular, after delivery of a slurry and a post-flushing with water, the drum 21 is rotated to impact plate the delivered powder particles in the slurry onto parts or articles within the drum 21. During this processing, portions of the fluid, impacting medium or other particles may enter the outlet openings 67 and the elongated tube 65. Such an entry may cause fouling or clogging of the openings 67 or the elongated tube 65. Accordingly, the pre-flush with water prior to delivery of a new charge of slurry is effective to remove any such blockages and to ensure that the delivery of slurry is uniform throughout the drum.

It should be noted that the amount of unwanted material present in the tube 65 prior to pre-flushing is generally substantially less than the amount of slurry which remains in the fluid network including the pump 63 and the line 61 prior to post-flushing. Accordingly, the length of time over which water is supplied in the pre-flushing operation is substantially less than the length of time over which water is supplied in the post-flushing operation. In the preferred embodiment, the length of time for the pre-flushing is generally between 1 and 10 seconds while the length of time for the post-flushing is generally within the range of 3 to 20 seconds.

It should also be noted that the amount of water supplied in the pre-flushing and the post-flushing operations should be minimized in order to maintain the proper liquid levels within the drum 21. This minimization of water accomplishes both an ecological advantage and a process advantage. Since the water utilized for pre-flushing and post-flushing becomes contaminated during these operations or subsequent operations within the drum 21, it may be necessary to dispose of the water after processing. Accordingly, the less water which is employed in these operations the less quantity of water must be discharged and/or cleaned before discharge thereby protecting and preserving the environment. Further, by utilizing a minimum amount of water, the relative quantities of slurry, and more particularly of metal powder particles, within the drum can be more carefully controlled.

In order to further ensure that the quantity of metal powder particles delivered to the drum 21 within the slurry is uniform, constant agitation by the agitator 27 within the slurry supply tank 25 is highly desirable. Such constant agitation of the slurry not only ensures uniformity of the composition of the slurry but also facilitates both transportation of the slurry within the fluid network and discharge of the slurry from the outlet openings 67.

The present invention provides a particularly efficient method of controlling the delivery of metal powder to a processing station. This control is achieved with a relatively simple apparatus. Further, by providing a pre-flushing and a post-flushing step within the fluid network for supplying the slurry of the powder particles, longer continuous operation of the delivery network is accomplished. In particular, the pre-flushing and post-flushing steps eliminate the need for periodic stoppages of the process to clean clogged orifices, pumps or interconnecting lines. Still further, the present invention provides a uniform distribution of the metal power particles to a rotatable plating drum by the provision of a plurality of outlet openings arranged parallel to a longitudinal axis of the drum. Moreover, the method and apparatus according to the present invention are readily adaptable for use with various different slurries and processes by a simple adjustment of the predetermined times established by the timer. In other words, if longer slurry delivery time or a longer post-flush is required, the timer is merely reset to the appropriate value prior to the initiation of the process.

The principles, preferred embodiment and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined by the claims be embraced thereby.

What is claimed is:

1. A method of controlling the delivery of metal powder to an outlet within a rotatable drum, said drum being adapted for impact plating of the metal powder onto articles, comprising the steps of:

supplying a slurry of the metal powder;

delivering water from a water supply through a fluid network to an outlet within the drum;

stopping delivery of the water after a first predetermined length of time;

subsequently delivering the slurry to the drum through the fluid network and stopping the slurry delivery after a second predetermined length of time; and subsequently delivering water from the water supply through the fluid network and stopping the water delivery after a third predetermined length of time.

2. The method of claim 1, further comprising the step of agitating the slurry within a supply tank.

3. The method of claim 1, further comprising the step of minimizing the quantity of water delivered to the drum.

4. The method of claim 3, wherein the quantity of water is minimized by reducing at least one of the first and third predetermined lengths of time.

5. The method of claim 1, wherein the first predetermined length of time is substantially less than the third predetermined length of time.

6. The method of claim 1, wherein the first predetermined length of time is 1–10 seconds and the third predetermined length of time is 3–20 seconds.

7. The method of claim 1, further comprising the step of discharging the slurry from the outlet generally uniformly along an axis of the drum while the drum is rotating.

8. A method of intermittently delivering an insoluble powder to a processing station, comprising the steps of:

supplying a slurry comprised of the insoluble powder and at least water;

pre-flushing a fluid network for supplying fluids to the processing station;

delivering a predetermined quantity of the slurry through the fluid network to the processing station;

post-flushing the fluid network to remove any residual slurry; and agitating the slurry prior to delivery to the fluid network.

* * * * *